United States Patent [19]

Goldfarb

[11] 4,237,650

[45] Dec. 9, 1980

[54] PRESCHOOL PLAY APPARATUS

[76] Inventor: Adolph E. Goldfarb, 4614 Monarca Dr., Tarzana, Calif. 21356

[21] Appl. No.: 10,925

[22] Filed: Feb. 9, 1979

[51] Int. Cl.[3] ..... A63H 5/00

[52] U.S. Cl. ..... 46/175 R; 46/1 R; 46/33; 434/259

[58] Field of Search ..... 46/1 R, 16, 33, 239; 35/9 R, 22 A, 22 D, 6; 273/1 M, 1 Q

[56] References Cited

U.S. PATENT DOCUMENTS

| | | | |
|---|---|---|---|
| 2,624,126 | 1/1953 | Bolognino et al. | 35/6 X |
| 2,774,150 | 12/1956 | Genin | 35/22 A |
| 3,305,966 | 2/1967 | Thornell | 46/33 |
| 3,305,967 | 2/1967 | Weisbecker | 273/1 M X |
| 3,478,452 | 11/1969 | Bidwell et al. | 46/239 X |
| 3,572,719 | 3/1971 | Span et al. | 273/1 M X |
| 3,650,064 | 3/1972 | Fusco | 35/22 A X |
| 3,795,063 | 3/1974 | Nelson | 35/9 D X |

*Primary Examiner*—F. Barry Shay

*Attorney, Agent, or Firm*—Robert M. Ashen; Robert J. Schaap

[57] ABSTRACT

A preschool play apparatus comprising a base having a wall defining a plurality of different shape holes. There is a translucent viewing window in the wall adjacent each of the holes. There are also a plurality of plugs or inserts having shapes which match the shapes of the holes. The child-user attempts to insert the plugs in the holes of matching shapes. When he or she is successful at inserting a plug, the inserted plug engages a mechanism which moves a picture up to the adjacent translucent window so that the picture is visible through the window. The base may take the form of a play telephone switchboard, with the plugs being attached to telephone lines or cords secured to the switchboard. The windows are translucent such that the pictures are readily visible without backlighting when they are adjacent the windows, but are not readily visible when spaced away from the windows.

9 Claims, 5 Drawing Figures

FIG. 2
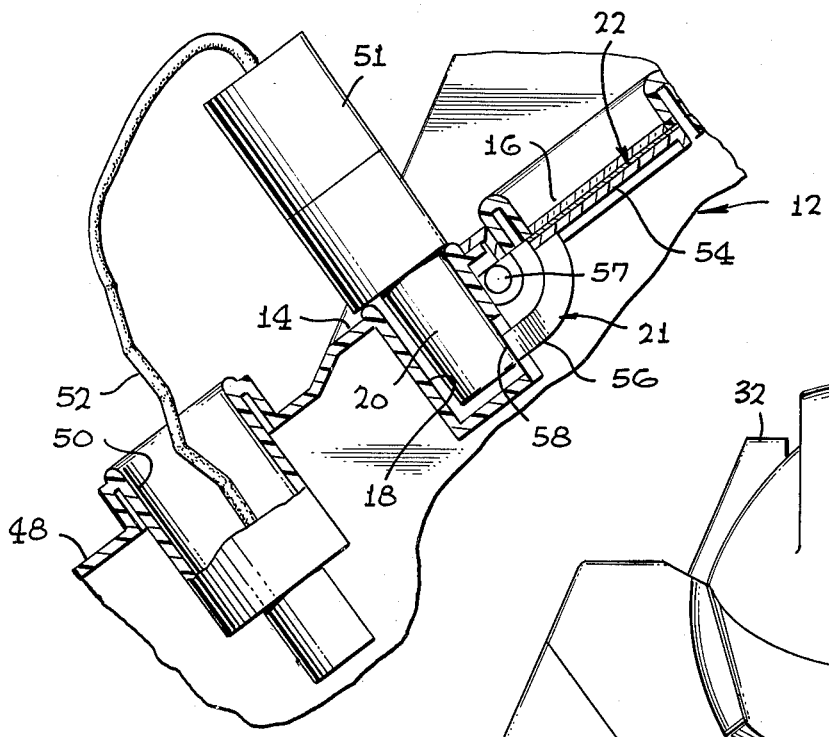
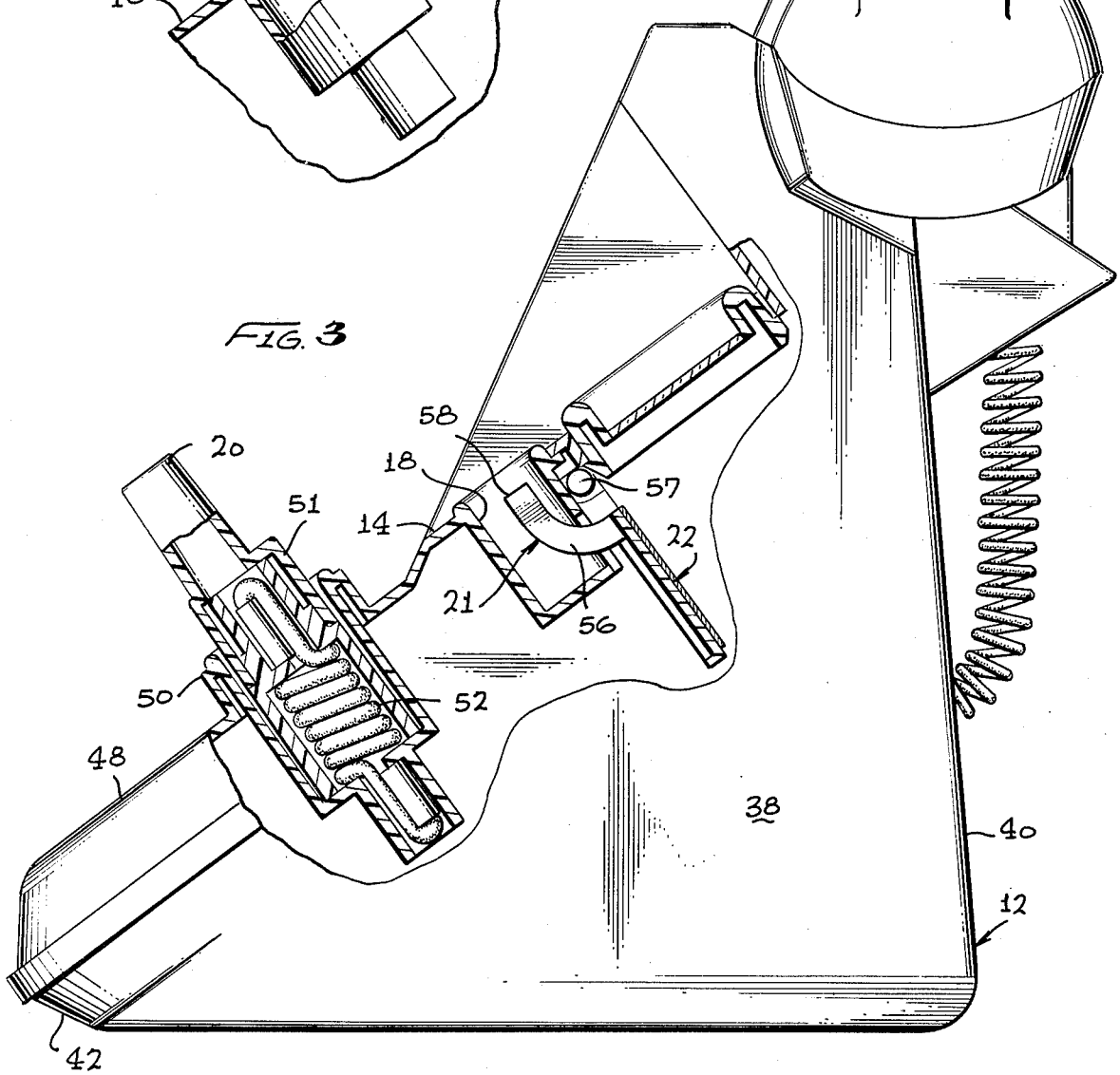
FIG. 3

PRESCHOOL PLAY APPARATUS

This invention relates to a pre-school play apparatus of the type where a child must match pegs or plugs or different shapes with holes of corresponding different shapes. The apparatus of the present invention contemplates bringing a different picture into view of the child each time he or she is successful in inserting a peg of the proper shape into a hole of the corresponding shape.

In the prior art there were a variety of this type of apparatus where the young child was required to match pegs of different shapes with holes having corresponding different shapes. In some forms the pegs would simply pass through the holes into a container or the like. In other versions the pegs might be retained in the holes in which they were properly positioned.

Another class of play apparatus provided pictures or the like behind solid doors or covers which the child could open.

In still another prior art toy, pictures were provided behind thick translucent windows such that the picture was not visible to the child until a light behind the picture was illuminated to make the picture visible through the thick translucent window.

The device of the present invention contemplates, in a preferred form, a plurality of translucent windows each having a picture which is movable between a first position where the picture is spaced from the window and therefore cannot be seen through the window and a second position where it is immediately behind or against the rear side of the window and can be viewed through the window. Each of the windows in the preferred device is associated with a hole of a different shape and the child is provided with a plurality of plugs or pegs having shapes matching the shapes of the holes. When the child successfully inserts a plug of the right shape through a mating hole, the plug engages a mechanism which moves the picture from the first position where it is spaced from the window and not visible, to the position where it is adjacent or in contact with the window and thereby visible to the child. Thus, a simple mechanical device creates the illusion to the child of a picture appearing when the child successfully accomplished the task of inserting the peg in the proper shaped hole. No light source is required, which provides obvious advantages; there is no need to provide for a power source either by wall plug-in or by the use of batteries which wear out and must be replaced; there is no danger to the young child from the use of electrical energy; there is no need for electrical circuitry or switches or the like or for batteries or a light bulb; there is a resultant saving in costs of production as well as the avoidance of well-known malfunction from electrically operable devices of this type.

In the drawings:

FIG. 2 is a side sectional view taken generally along line 2—2 of FIG. 1, showing one of the pictures in its first or non-visible position;

FIG. 3 is a view of a portion of FIG. 2, showing the picture in its second or visible position;

Figure 1:
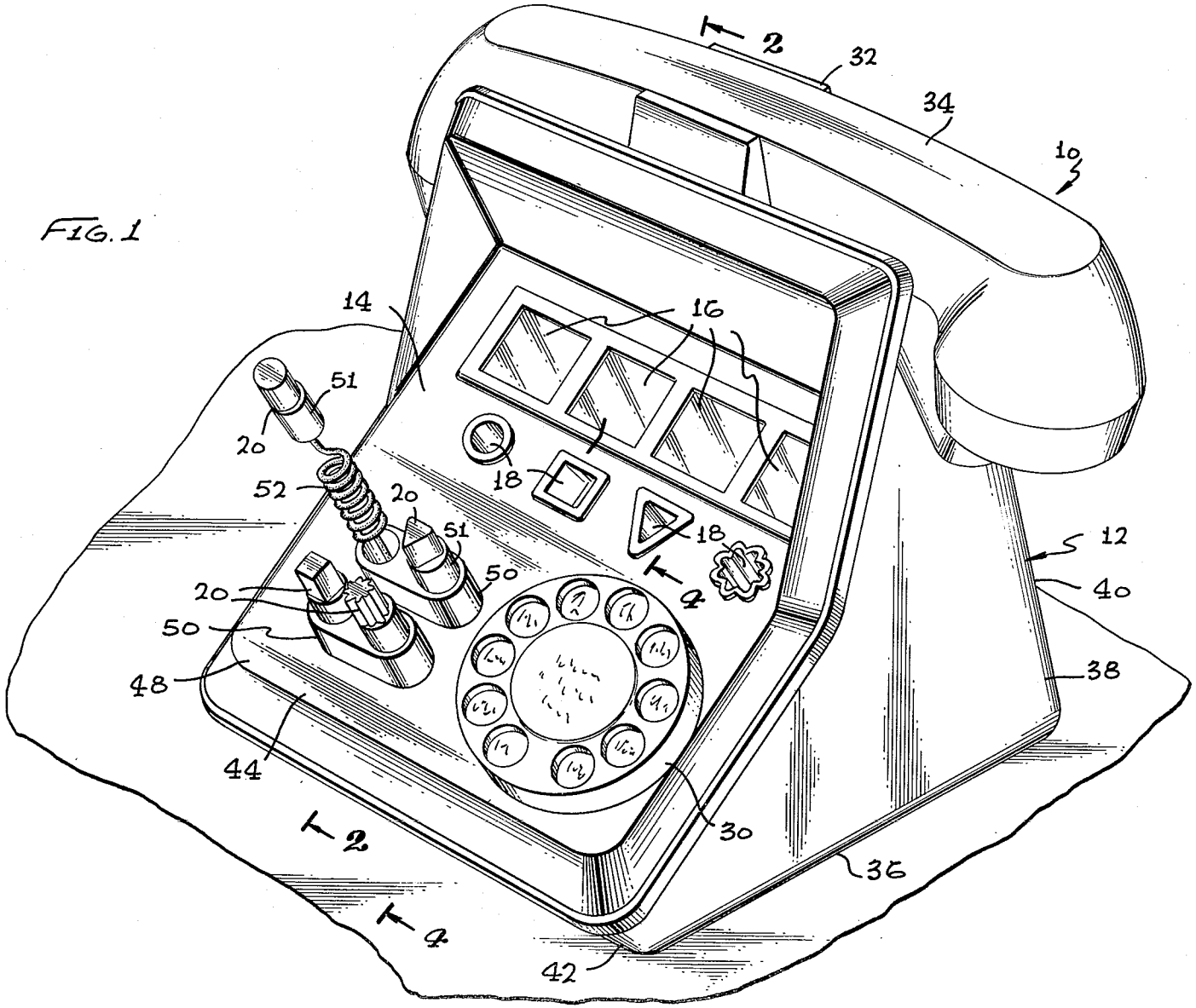
FIG. 1 is a perspective view of a preschool play apparatus embodying a presently preferred form of the invention.
Figure 4:
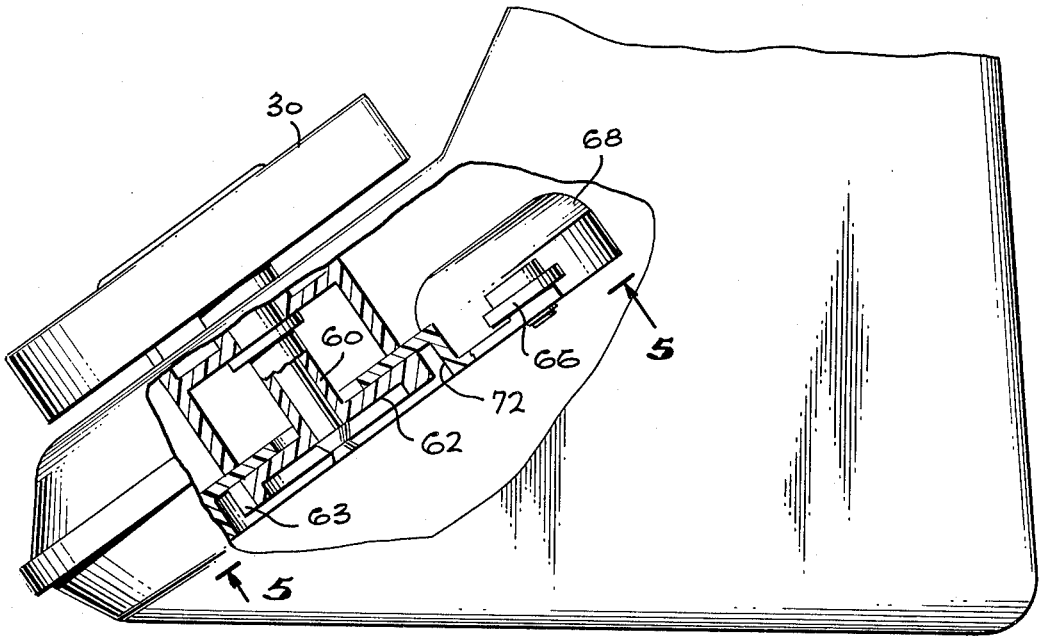
FIG. 4 is a side sectional view taken generally along line 4—4 of FIG. 1.

The illustrated preschool play apparatus 10, which is a presently preferred embodiment of the invention, is illustrated in FIGS. 1 through 5. In general, apparatus 10 comprises a base or housing 12 having a wall section 14 with a plurality of translucent windows 16. Associated with each window 16 there is a different shape hole 18 in the wall section. The apparatus includes a plurality of pegs or plugs 20 of different shapes corresponding to the shapes of the holes. A picture 22 is associated with each window 16 and is pivotly mounted adjacent the window for movement between a first position, as shown in FIG. 2, where the picture is spaced from the translucent window 16, and a second position, as shown in FIG. 3, where the picture is positioned adjacent to or against the rear of the translucent window. When spaced from the translucent window, the picture cannot be seen through the window by the child. When the picture is adjacent to or up against the window, the picture can be seen by the child. In use of the apparatus, the child attempts to place the proper shaped peg 20 into the hole 18 of the corresponding shape. When the child does this, the peg 20 engages means 21 associated with the picture to move the picture from the first position to the second position.

Now to consider the illustrated apparatus 10 in further detail. Apparatus 10 is shown in the form of a representation of a telephone switchboard. The base of housing 12 is formed externally to present the apparatus of a large telephone receiver having a dial 30 and a cradle section 32 for supporting a simulated hand holdable telephone speaker/receiver 34. The housing 12 is a generally hollow box-like structure having a bottom wall 36, side walls 38, a rear wall 40, a front wall 42 and a two section inclined top wall 44. The housing may be made of any suitable material such as plastic, cardboard, metal, etc. The windows 16 and holes 18 are provided in the rear section 14 of top wall 44; the dial 30 and holders 50 for the pegs 20 are provided on the forward section 48 of the wall 44. The pegs may each be attached to the housing by a suitable cord 52. The cords 52 are long enough to permit the pegs to be inserted through an associated holes 18. The cords also serve to prevent the pegs from being separated from the housing and thus lost by the child-user. The illustrated cords 52 are coiled to simulate the appearance of switchboard lines.

The illustrated switchboard apparatus 10 has four of the generally rectangular windows 16. Each window 16 is provided by a cut-out in the wall section 14 and by a sheet section of translucent material such as frosted plastic, frosted glass, or the like. The window must be sufficiently translucent so that when a picture is disposed immediately behind the window it may be adequately visible to the child through the frosted or translucent window. Thus, for example, a thicker less translucent window such as was used in the prior art in association with an electric light source would not be suitable since the child could not see the picture if such a window were used in the present apparatus without a light. In addition, the window needs to be sufficiently opaque so that the picture cannot be readily seen by the child when the picture is in the first position spaced away from the window such as shown in FIG. 2. The material forming the window may be a separate piece secured to the wall of the switchboard housing as shown in FIGS. 2 and 3. The illustrated windows 16 are arranged side by side on wall section 14 with each hole 18 located directly below the associated window.

The number of windows and their particular locations, size and shape may be varied as desired. Similarly, the size and particular shapes of the holes and the mating pegs may be varied as desired. The illustrated holes and pegs are a circle, a square, a triangle, and a fluted shape for simplicity and purposes of representation. Each of these illustrated plugs will fit into the hole having a matching shape but will not fit into any of the other holes.

Each of the illustrated plugs 20 includes the peg or plug itself of the desired configuration at one end and a handle section 51 at the other end. Each of the illustrated holders 50 is a receptacle adapted to receive one of the handle sections 51. One end of the associated cord 52 is secured in the bottom center of each holder receptacle 50. The handle section 51 of each plug is generally hollow and open at its end to receive the coiled cord when the handle section is disposed within the holder-receptacle 50 as shown best in FIG. 2. The other end of the associated cord is secured to the inside of the handle section 51. In this way the plug itself is disposed outwardly when the handle section is in a holder 50, so that the young child can easily see the configuration of the plugs and select the one he or she desires the use. As shown in FIGS. 2 and 1, enough of the handle section 51 is exposed even when the handle section is within the holder-receptacle 50 so that the child can grasp the plug by the handle section when removing it from the holder.

Figure 5:
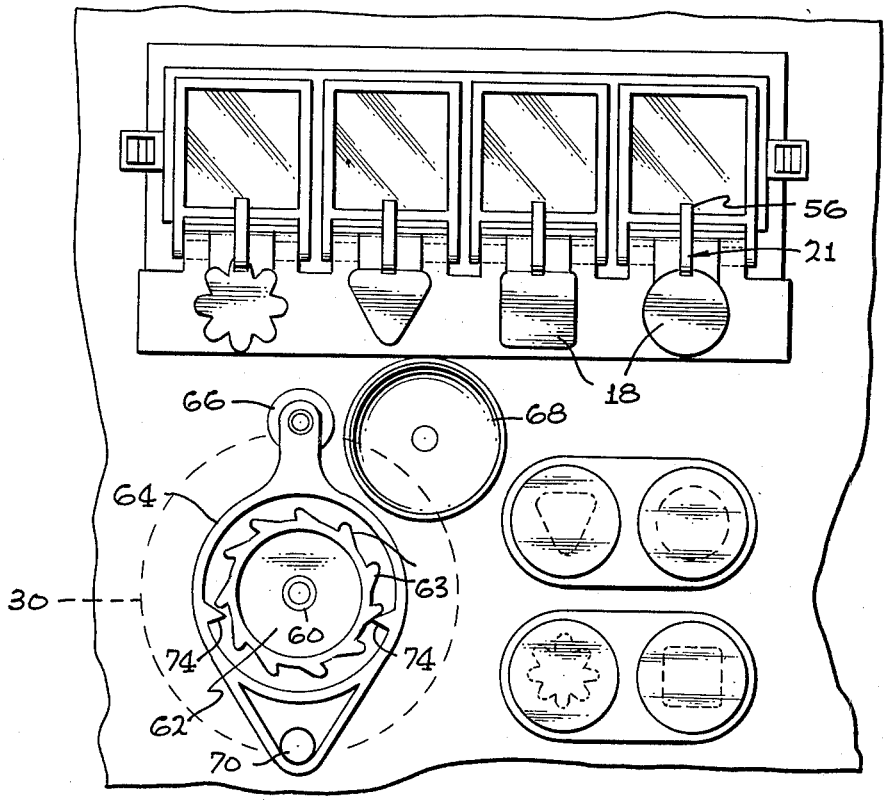
FIG. 5 is a rear internal view taken generally along line 5—5 of FIG. 4.

As shown in FIGS. 2, 3 and 5, in the illustrated apparatus 10 the means 21 for moving each picture 22 comprises a molded part having a rectangular plate 54 to which the picture is secure and an arcuate shaped tab 56 secured at one end to the lower edge of the plate 54. Each tab 56 has a contact end 58 at its other end. The plate 54 and the contact end 58 on the tab 56 are at an angle to one another, which angle is less than 180° by a number of degrees generally equal to the angle by which the picture is spaced from the window when the picture is its first position as shown in FIG. 2. In other words, if the picture in its first position is spaced 90 ° from the rear of the window, the angle between the plate and the tab end would be 180° minus 90°, or 90°. These angles may be varied so long as the desired results are provided in that the picture is not readily visible when it is in the first position and the picture is readily visible when it is in the second position. As seen in FIGS. 2 and 3, each part 21 is pivotly attached to the rear of the switchboard housing wall section 14 immediately below the associated window for rotation about a transverse axis 57 and so that the tab 56 extends into the associated hole 18. The illustrated wall section 14 is at an angle of approximately 45° from the horizontal. Thus, the illustrated pictures 22 and plates 54 extend downwardly at about 45° to the vertical when in their first positions (FIG. 2). This arrangement permits the weight of gravity on the pictures and plates to maintain them in the first or non-visible position without the use of springs or other biasing means. Other orientations could be used however, in which case suitable biasing means in the form of springs or the like could be utilized to maintain the picture spaced away from the window until the proper plug was inserted into the associated hole.

When a peg 20 is inserted through an associated hole 18, the peg engages the associated tab 56 and moves that tab to the position shown in FIG. 3. This also moves the associated picture plate 54 and the picture on that plate to the position shown in FIG. 3 where the picture is at or against the rear of the translucent window and is visible to the child.

The illustrated apparatus also includes means for dialing and for ringing a bell in response to the dialing. As noted above, a dial 30 is rotatably mounted on the wall section 48. As seen best in FIG. 4, the dial 30 is disposed on top of the wall section 48 and is secured to one end of a shaft 60 which extends through the wall section 48. The shaft 60 is freely rotatable. The inner end of the shaft 60 which is within the housing 12 carries a wheel 62 that has a series of angularly extending spaced apart drive teeth 63 around its peripheral edge. The wheel 62 may be seen best in FIGS. 4 and 5. A pivoted member 64 is engaged by the rotation of the wheel 62 to cause a bell-ringing clapper 66 to engage a bell 68 to stimulate the ringing of a phone or the like. More particularly, as shown in the drawings, the member 64 is pivotally mounted at one end within the housing for rotation about an axis 70. The member 64 has an enlarged central portion which has a large opening 72 within which the tooth wheel 62 is disposed. The member 64 essentially forms a ring around the wheel 62. Within the opening 72 are a pair of opposed driven teeth 74 that are alternately engaged by the drive teeth 63 of the wheel 62 as the wheel 62 rotates. In other words, as the wheel 62 is rotated by the dial 30, the teeth 63 of the wheel first engage one of the teeth 74 on the pivoted member 64 to thrust it in one direction and then engage the opposed tooth 74 of the member 64 to pivot that member in the opposite direction. This causes the upper end of the member 64 where the clapper 66 is mounted to essentially reciprocate back and forth so as to bring the clapper into and out of engagement with the bell 68 which is mounted in proximity to the clapper 66 by suitable means (not shown). Thus, ringing of the bell is achieved by a relatively simple, mechanical arrangement which does not involve springs or require batteries or other electrical power, and is thus particularly suitable for use by young children.

The illustrated construction provides a low cost, low maintenance dependable and simple, as well as economical, apparatus and is therefore the presently preferred form of the apparatus of the invention.

Various pictures can be used to represent different scenes or pictures. Such scenes or pictures could be associated with the holes and pegs as for example, the holes could have the shape of different animals and pictures could present the associated animals. Further, the pictures could be removeably secured to the picture plate so that they could be changed when desired.

Various modifications and changes may be made in the specific details of the illustrated apparatus without departing from the spirit and scope of the present invention, as set forth in the following claims.

What is claimed is:

1. a preschool play apparatus comprising:

(a) a base having a wall;

(b) means on said wall defining a plurality of openings of different shapes;

(c) means on said wall defining a plurality of windows in said wall, each of said windows being associated with one of said openings;

(d) a plurality of pictures, each being positioned at a respective one of said windows for being viewed through that window;

(e) means for moving each of said pictures between a first position spaced away from said window and a second position adjacent to said window;

(f) a layer of translucent material disposed across each of said windows, said layers having such thickness and such translucent characteristics that the associated picture can be readily seen through the layer without backlighting when the picture is in said second position adjacent to said layer but said picture cannot be readily seen through said layer when said picture is in said first position spaced from said layer, and (g) a plurality of plug means of different shapes, each of said plug means having a shape matching the shape of one of said openings so that each of said plug means will fit into a matching opening but will not fit into the other openings, each of said pictures being movably mounted on said wall adjacent the associated window and the associated moving means comprising an element associated with said picture and disposed at said associated opening when said picture is in said second position, said element being movable by the plug means fitting into the associated opening to thereby move the picture to its first position where it may be viewed through the translucent window layer.

2. A play apparatus as called for in claim 1 wherein each of said pictures is pivotally mounted for rotational movement toward and away from the associated window.

3. A play apparatus as called for in claim 2 wherein each of said pictures is pivotally mounted on a generally horizontal transversely extending axis disposed below the associated picture, and each of said openings is below the associated window.

4. A play apparatus as called for in claim 1 wherein said pictures are normally biased to said first position by the force of gravity.

5. A play apparatus as called for in claim 1 further comprising a bell-ringer mechanism comprising:

(1) a bell mounted on said apparatus;

(2) a member having a longitudinal axis and opposed ends and being pivotally mounted adjacent one of said ends on said apparatus, said member having an aperture intermediate said ends with a pair of opposed driven teeth extending inwardly from opposite sides of said aperture transversely spaced from the longitudinal axis of said member;

(3) a clapper mounted on the other of said ends of said member and being disposed adjacent to said bell for movement into and out of engagement with said bell incident to pivotal movement of said member; and (4) a rotatable wheel disposed within said aperture and having a plurality of drive teeth configured and arranged with regard to said opposed driven teeth to alternately engage said drive teeth and thereby reciprocally pivot said member back and forth so as to cause said clapper to repeatedly strike said bell.

6. A play apparatus as called for in claim 1 wherein each of said plug means is connected to said base by a flexible cord.

7. A play apparatus comprising:

(a) a wall;

(b) means defining a window in said wall, the window extending in a plane;

(c) a picture associated with said window; means for moving at least a major portion of said picture in a direction generally transverse to said plane so that said picture is moved between a first position spaced away from said plane of said window and a second position adjacent to said plane of said window, said means for moving said picture comprising a picture-supporting element which is mounted by pivot means located on the rear of said wall adjacent to an edge of said window; and (d) a layer of translucent material disposed across said window, said layer having such thickness and such translucent characteristics that the said picture can be readily seen through the layer without backlighting when the picture is in said second position adjacent to said layer, but said picture cannot be readily seen through said layer when said picture is in said first position spaced from said layer.

8. A play apparatus as called for in claim 6 further comprising means on said wall adjacent to said window to define an opening through said wall, said means for moving said picture including a contact portion disposed in said opening for being engaged to move said picture between said first and second positions.

9. A play apparatus as called for in claim 8 further comprising at least two plugs of different shapes, one of said plugs having a shape such that when it is inserted into the opening it will engage said contact portion of the means for moving said picture so as to move said picture from said first position to said second position, said other plug having a shape such that it may not be inserted into said opening.

* * * * *